US006547336B2

(12) United States Patent
Hoffmann

(10) Patent No.: US 6,547,336 B2
(45) Date of Patent: Apr. 15, 2003

(54) OPEN CAST MINING DEVICE AND APPARATUS FOR TESTING THE CUTTING MINABILITY OF CRITICAL MATERIAL

(75) Inventor: Dieter Hoffmann, Leipzig (DE)

(73) Assignee: Man Takraf Fördertechnik GmbH (DE)

( * ) Notice: Subject to any disclaimer, the term of this patent is extended or adjusted under 35 U.S.C. 154(b) by 0 days.

(21) Appl. No.: 09/827,695

(22) Filed: Apr. 6, 2001

(65) Prior Publication Data

US 2001/0038236 A1 Nov. 8, 2001

(30) Foreign Application Priority Data

Apr. 20, 2000 (DE) ..... 100 19 748

(51) Int. Cl.[7] ..... E21C 41/26
(52) U.S. Cl. ..... 299/10; 299/36.1; 299/95
(58) Field of Search ..... 299/36.1, 39.1–40.1, 299/95, 10

(56) References Cited

U.S. PATENT DOCUMENTS

| | | | | | |
|---|---|---|---|---|---|
| 4,041,623 | A | * | 8/1977 | Miller et al. | 172/4.5 |
| 4,755,001 | A | * | 7/1988 | Gilbert | 299/39.8 |
| 5,110,189 | A | * | 5/1992 | Haines | 299/30 |
| 5,378,080 | A | * | 1/1995 | Dickson | 299/39.5 |
| 5,846,026 | A | * | 12/1998 | Gilbert et al. | 37/142.5 |

FOREIGN PATENT DOCUMENTS

| | | | |
|---|---|---|---|
| AU | 199944875 | A1 * | 3/2000 |
| DE | 34 43 909 | | 6/1986 |
| DE | 199 41 799 | | 6/2000 |

OTHER PUBLICATIONS

EIMCO Dash Series Continuous Miners brochure, undated.*

* cited by examiner

*Primary Examiner*—David Bagnell
*Assistant Examiner*—John Kreck
(74) *Attorney, Agent, or Firm*—McGlew and Tuttle, P.C.

(57) ABSTRACT

A surface mining and testing apparatus and system provides for the adaptation of a surface miner to the specific geological conditions of a new area of use. The special features of the surface miner are the arrangement of the milling roller (5) in front of the chassis (1) in the direction of mining, the undershot direction of rotation of the milling roller (5), as well as the adjustability of the milling roller (5) in its height and transverse slope in relation to the level. These functional features are accomplished with the testing apparatus in order to obtain the same kinematic conditions as in the surface miner. To make it possible to extrapolate the results obtained with the testing apparatus to the surface miner, the parameters overall weight, drive output and throughput of the testing apparatus are used as constant, lower ratios in relation to the surface miner. The circumferential velocity of the cutting tools (13) and the force acting on each of the individual cutting tools (13) shall be equal in the testing apparatus and the surface miner. To achieve this, the velocity of travel of the apparatus, which is also the rate of feed, as well as the speed of rotation of the roller, which determines the circumferential velocity of the cutting tools (13), which is also the cutting speed at the same time, are variable. Since the testing apparatus is substantially smaller than the surface miner and the changing of relevant parameters of the apparatus is simpler, costs are saved during the technical adaptation of the surface miner to the specific geological conditions of the site of use.

19 Claims, 5 Drawing Sheets

OPEN CAST MINING DEVICE AND APPARATUS FOR TESTING THE CUTTING MINABILITY OF CRITICAL MATERIAL

FIELD OF THE INVENTION

The present invention pertains to a continuously operating, self-propelled apparatus for open cast mining and testing the minability of mineral raw materials and rock veins with properties that are critical from the viewpoint of separation and passing on in surface mining according to the preamble of the principal claim. It is preferably used as a testing apparatus (auxiliary apparatus) for the simple and inexpensive determination of the optimal apparatus parameters as the basis for the adaptation of a surface miner (final apparatus) to the specific geological conditions of a new field of use, but it is also suitable for use as a small, simple surface miner for small deposits of mineral raw materials and for exposing these raw materials.

BACKGROUND OF THE INVENTION

According to Ref. No. DE 199 41 799.7 [U.S. patent application Ser. No.: 09/385,944), a surface miner with a roller-shaped mining member has been known for the selective mining of mineral raw materials occurring in sedimentary beds and for exposing these raw materials. It comprises a substructure with a three-track (caterpillar) chassis; the superstructure with the drive container and the driver stand is arranged on the substructure. The milling roller module, comprising the transverse frame, the milling roller and the takeup chute, is rigidly fastened to the superstructure in front of the three-caterpillar chassis in the direction of travel, which is also the direction of mining. The discharge belt, which is followed by the loading belt arranged pivotably on the superstructure, is located behind the milling roller module in the area of the substructure and the superstructure in the direction in which the separated material is conveyed. To adjust the height of the milling roller in relation to the track level and consequently to set the depth of milling, lifting cylinders are provided as adjusting members on both sides between the substructure and the superstructure. The lifting cylinders can be actuated independently from one another. Due to the rigid arrangement of the milling roller module on the superstructure, the depth of milling during the first cut into a block being mined and during moving out of this block being mined is changed due to the change in the height of the superstructure. Since the apparatus always travels on the freshly cut level during the mining operation due to the milling roller being arranged in front of the chassis, the cutting circle diameter formed by the milling tools in the block being mined is again brought into the middle position during the mining operation, so that the apparatus will mine a uniform block height. If it is necessary to bring the milling roller into an oblique position in relation to the track level at right angles to the direction of travel; this can be achieved by means of a different actuation of the lifting cylinders. Smooth run of the milling roller is achieved due to the stable and robust design of the apparatus even in the case of hard materials to mine.

The parameters of the apparatus, such as the size of the apparatus, the output of the drives and the speed of cutting and feed of the surface miner are determined based on the intended mining output. The number and the arrangement of the cutting tools as well as of the material guiding and material ejection means on the circumference of the milling roller and the cutting tools themselves are selected as a function of the properties of the material to be mined and the requirements imposed on the particle size of this material. The service life of the tools plays an important role as well.

If a surface miner is to be prepared for use in an area that has critical properties different from those of the hitherto known areas of use and the specific requirements on the apparatus cannot be derived empirically, the foreseeably necessary drive output is first determined, the geometry of the milling roller is set and the most suitable tools are selected on the basis of theoretical knowledge and practical experience. Experience gained under comparable conditions of use is taken into account as well. However, corrections will be made if it is found during the trial run that the apparatus was not adjusted optimally. In the simplest case, better results can be obtained even with different tools, which can be easily replaced as expendable parts. However, the necessary changes can be achieved in the extreme case only by converting the apparatus, e.g., by equipping it with a different milling roller and with more powerful drives. The costs for this increase linearly with the size, the performance capacity and the technical furnishing of the apparatus.

The causes for the uncertainties in the adaptation of a surface miner to the specific conditions of use are that these conditions may be very extreme and multifaceted. The practical applications can never be simulated 100% even in laboratory tests.

SUMMARY AND OBJECTS OF THE INVENTION

The basic object of the present invention is therefore to develop a simple apparatus with which trials concerning the behavior during the use of the machine (vibrations, noise, cutting behavior and wear resistance) can be performed directly at the site of use for highly differentiated applications. These data obtained with the testing apparatus shall then be embodied in the surface miner which is larger and is also better equipped technically. As a small surface miner of a simple design, the apparatus shall be suitable for removing rock veins and for mining mineral raw materials of small thickness.

This object is accomplished with a testing apparatus with which the same working movements relevant for the mining operation can be performed, in principle, as with the surface miner to be optimized, but which is smaller and has a simpler design and is therefore substantially lighter and can thus be transported at a low cost to each site of use being considered and can be used there.

According to the invention an apparatus for open cast mining and testing the cutting minability of critical material is provided with a track (caterpillar type) chassis, an apparatus frame with a drive unit as well as a driver stand and a milling roller. The milling roller is arranged in front of the chassis in the direction of travel and rotates around a horizontal axis of rotation at right angles to the direction of travel. The milling roller operates with undershot and can be raised and lowered. The milling roller extends over the entire width of the apparatus and is equipped with cutting tools, guide plates and ejection plates. The milling roller is in functional connection with a ring chute. The overall weight, the drive output and the throughput of the apparatus (testing apparatus) are lower than those of the surface miner (final apparatus) at a defined ratio. However, the circumferential velocity of the said cutting tools and the force acting on the cutting tool are the same, and the speed of rotation of the roller and the rate of feed can be varied continuously to optimize the mining output.

To obtain usable data for the surface miner (final apparatus), certain premises must be met. Thus, the overall weight, the drive output and the throughput of the testing apparatus must be smaller than those of the surface miner at a defined ratio, but the force acting on the cutting tool (cutter) must be the same. To ensure that the force acting on a cutting tool is approximately equal to that acting in the final apparatus, the circumferential velocity of the milling roller and the rate of feed of the testing apparatus can be varied continuously.

The adjusting device adjusts the height and the transverse slope of the milling roller in relation to the level. This is achieved with only two lifting cylinders. Different depths of cut can be obtained by simply pivoting the milling roller by means of the adjusting cylinder. It is necessary to change the transverse slope of the milling roller when deposits of mineral raw materials are to be exposed or opened whose surface is sloped at right angles to the direction of feed or arched. The mining technology makes provisions for the axis of the milling roller to be positioned in parallel to the level after the elimination of the transverse slope during the removal of all further subjacent beds.

Straight-shank cutters are provided for equipping the milling roller with cutting tools. They are available in various shapes, degrees of hardness and materials. The suitability of various materials of the cutter cap and its heating as well as the resistance of the basic material of the cutter to wear are evaluated during the testing of the straight-shank cutters. The cutter holders are provided with bushings, by which the cutter holders are protected from wear and the rotary movement necessary for uniform wear and the self-sharpening effect of the straight-shank cutters is facilitated. These bushings are also expendable parts and can be replaced when needed. To increase the availability of the surface miner (final apparatus), tests are also carried out with the testing apparatus with the aim of increasing the service life of these bushings and consequently the interval at which they must be replaced.

Since the number of cutting tools must also be reduced in the testing apparatus of reduced size compared with the final apparatus in order to obtain comparable results, the cutting tools are arranged in only one helical line. By changing the speed of rotation of the roller and the rate of feed, the same force acting on the cutting tools is obtained as in the final apparatus.

The separated material is deposited between the two individual caterpillars of the chassis and loaded on trucks.

The operation of a large surface miner (final apparatus) can be simulated and tested with a testing apparatus of such a design under the special conditions of use at the site of use. Based on the reduction of the size of the apparatus compared with the surface miner and the reduction of the total weight, the drive output and the throughput at a constant ratio, which is to be determined, and the equal speed of cutting and the equal cutting force, the test results can be applied to the final apparatus.

Various tests can be performed to optimize the apparatus and to increase the output due to the fact that the speed of cutting and the rate of feed can be changed with the specific design of the testing apparatus and individual parts that are significant with respect to the output and the wear can be replaced and adapted. The implementation of the test results in the surface miner (final apparatus) is simpler and less expensive than in the case of the subsequent testing and optimization of a surface miner.

The testing apparatus can also be used as a surface miner. This applies especially to the opening and mining of smaller deposits of mineral raw materials.

Further details and advantages of the subject of the present invention will appear from the following description and the corresponding drawings, in which a preferred exemplary embodiment of an apparatus is shown, which is especially suitable for use as a testing apparatus for the optimal adaptation of a surface miner (final apparatus) to specific conditions of use, but can also be used as a surface miner.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
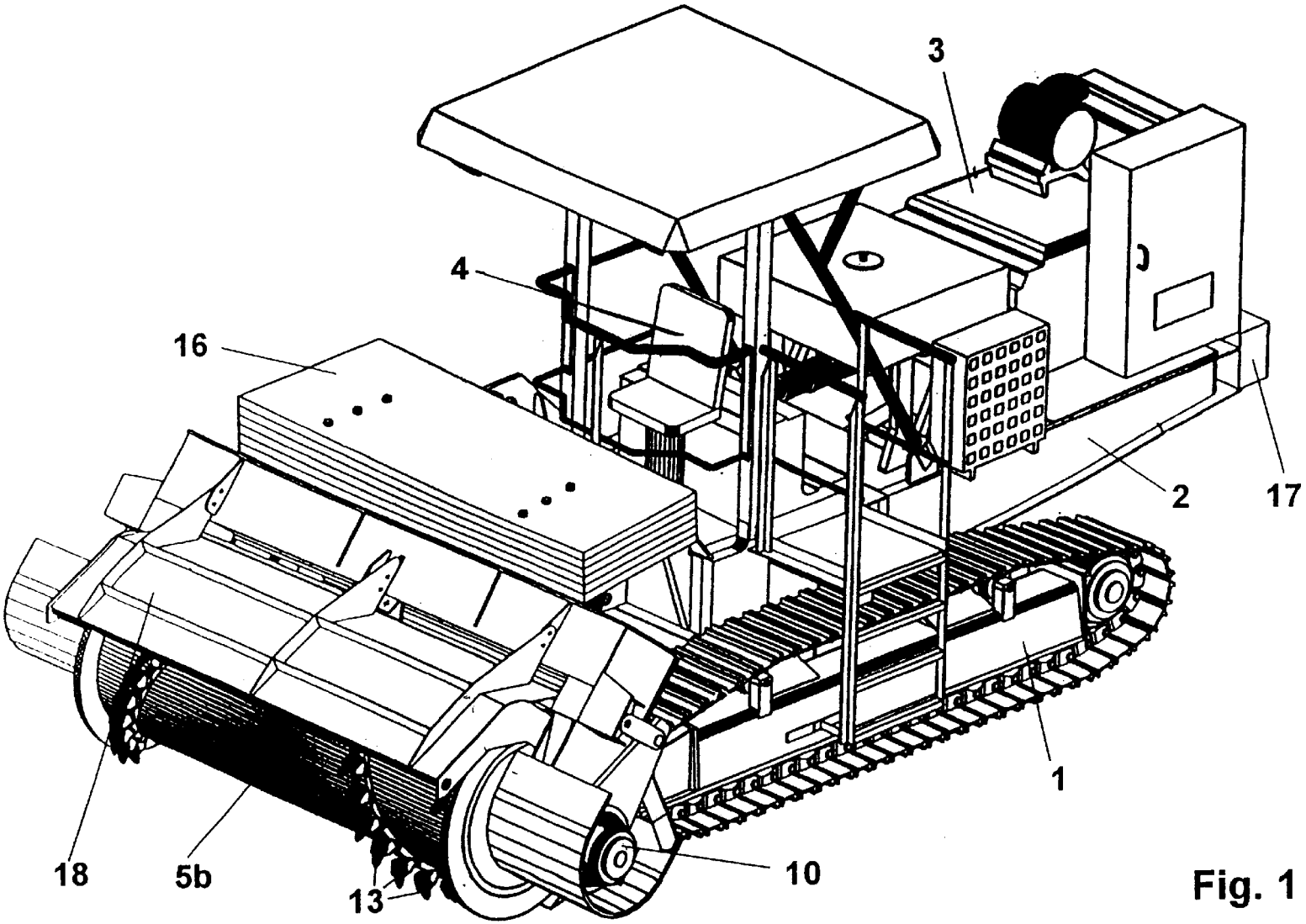
FIG. 1 is a perspective overall view of the apparatus according to the invention.

Referring to the drawings in particular, the apparatus is a open cast mining and testing apparatus for a surface miner in the design according to German Patent Application with Reference Number DE 99 41 799.7. and U.S. patent application Ser. No.: 09/385,944 (U.S. patent application Ser. No.: 09/385,944 is hereby incorporated by reference). Special features are the arrangement of the milling roller in front of the chassis in the direction of mining, the undershot direction of rotation of the milling roller, as well as the adjustability of the milling roller in its height and transverse slope in relation to the level. These functional features must be satisfied with the small size open cast mining device or testing apparatus in order to draw conclusions for the adaptation of the surface miner to the specific geological conditions of a new area of use.

Figure 2:
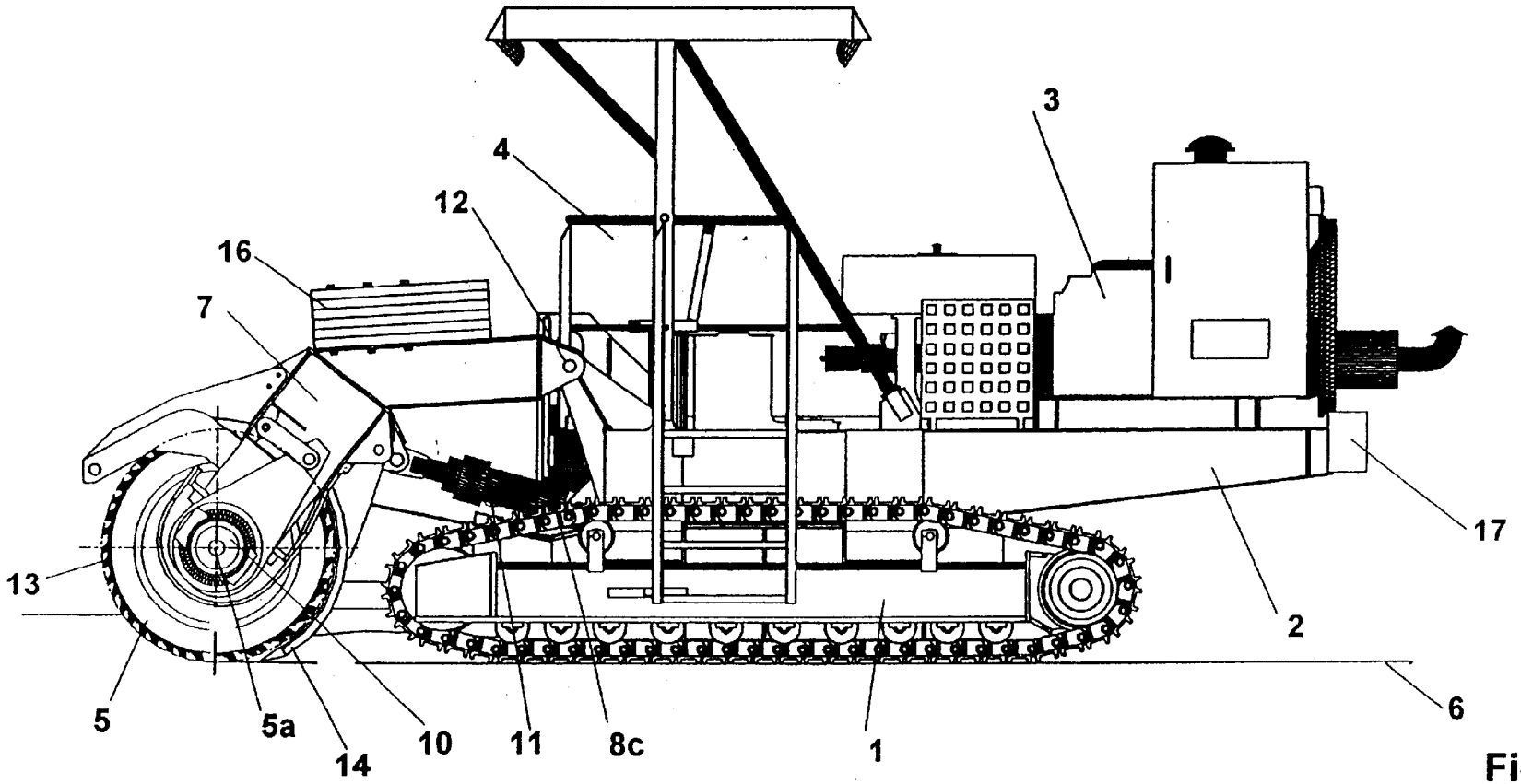
FIG. 2 is a side view of the apparatus according to FIG. 1.

According to FIGS. 1 and 2, the apparatus comprises the two-endless track (caterpillar type) chassis 1 and the apparatus frame 2. The apparatus frame 2 accommodates the drive unit 3 and the driver stand 4. The milling roller 5 is arranged in front of the chassis 1 in the direction of mining.

The mining technology for such a surface miner provides for the apparatus to cut a downward leading ramp from a starting position during its travel movement, for subsequently removing a block to be mined of an approximately equal height and of subsequently cutting out in an upward leading ramp. The adjacent blocks are then mined in alternating directions of advance. To cut into or remove overburden or a seam with oblique surface sloped across the direction of travel, the parallel position of the milling roller 5 in relation to the level must be changed into an oblique position. This also applies to the removal of concavely or convexly arched deposits.

The adjustability of the milling roller 5, which is necessary for accomplishing this mining technology, is achieved by means of two adjusting mechanisms. The first, principal adjusting mechanism provides for the pivoting of the milling roller 5 in relation to the frame 2 of the apparatus and thus for an adjustment in height in relation to the level 6, and the transverse slope of the milling roller 5 in relation to the level 6 on which the apparatus is moving is changed with the second, auxiliary adjusting mechanism.

Figure 3:
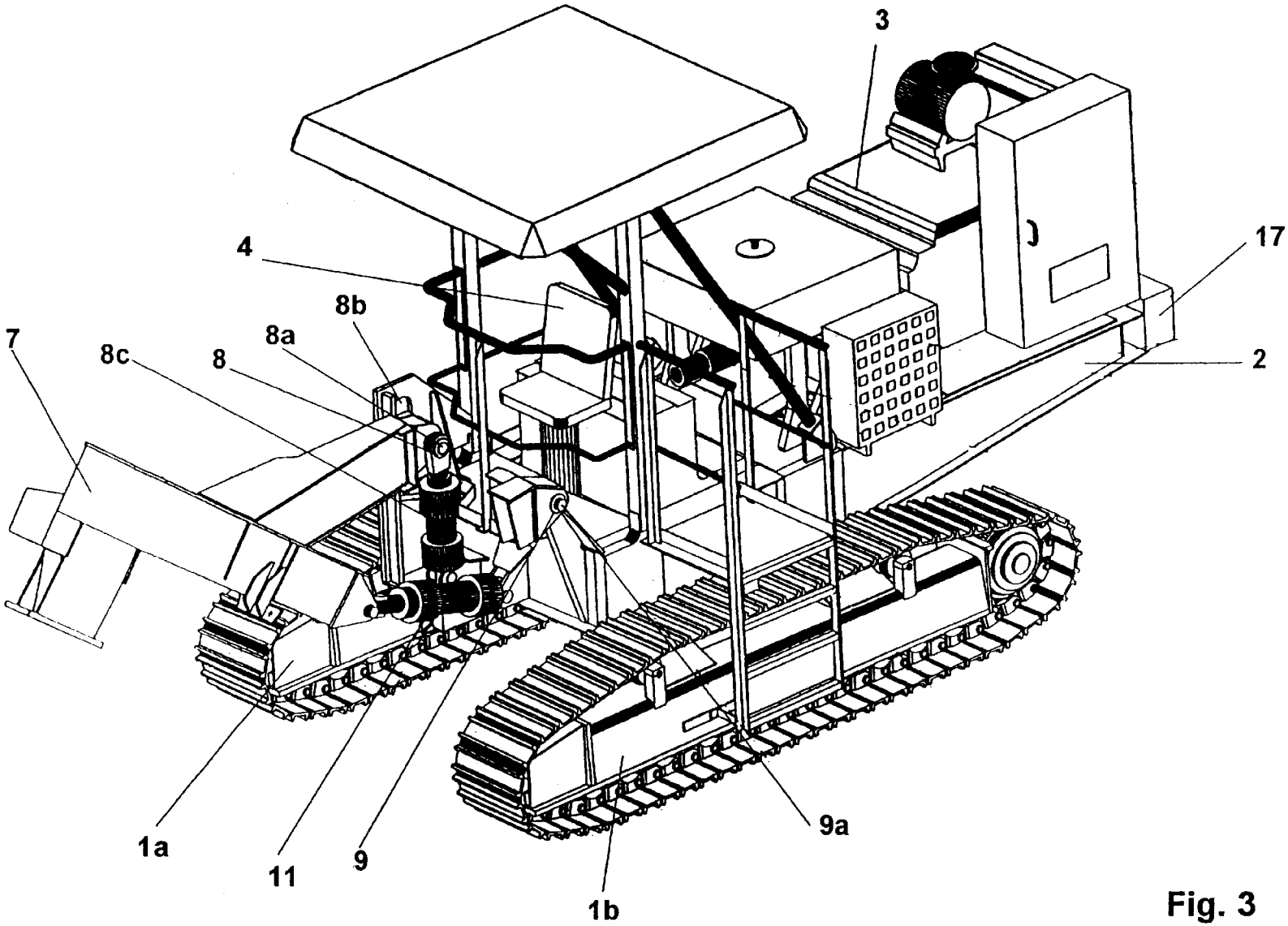
FIG. 3 is a perspective showing the arrangement of the adjusting members for the milling roller.
Figure 4:
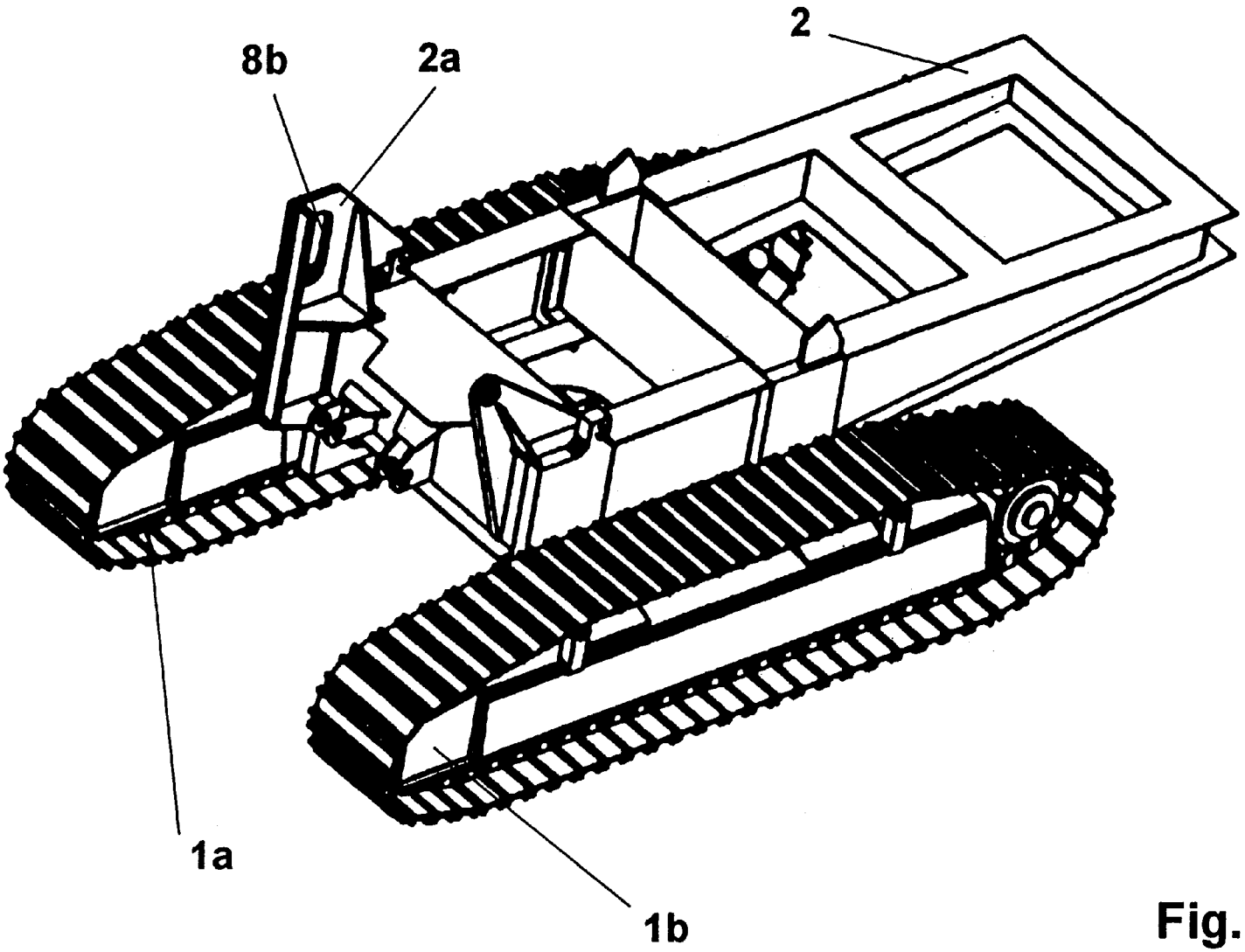
FIG. 4 is a perspective representation of the frame of the apparatus with the endless track (caterpillar) chassis.

The principal adjusting mechanism includes a support frame 7, which is shown completely in FIG. 2 and as a cutaway in FIG. 3. It is designed as a solid web construction and is arranged pivotably in a right-hand and left-hand hinge 8 and 9, respectively, on the frame of the apparatus 2 in the front in the direction of mining, which is also the direction of travel. The free end of this support frame 7 has a fork-shaped design and is provided with mounts for the shaft 5*a* of the milling roller. Drives 10, which are in functional connection with the shaft 5*a* of the milling roller, are arranged on the support frame 7 on both sides. A lifting cylinder 11 is provided for the pivoting movement of the support frame 7 and consequently for the height adjustment of the milling roller 5. Of the two hinges 8 and 9, which form the connection between the support frame 7 and the frame 2 of the apparatus, the left-hand hinge 9 is a stationary hinge and the right-hand one, 8, is adjustable in height. Both hinges 8 and 9 comprise two connection pins 8*a* and 9*a*, which are arranged in a common pivot axis 12. The connection pin 8*a* of the hinge 8, which is displaceable in height, receives in its middle the support frame 7; one end of this hinge is arranged longitudinally displaceably in a vertical guide groove 8*b*, which is located in a support 2*a* belonging to the frame 2 of the apparatus according to FIGS. 3 and 4, and its other end is in functional connection with a leveling cylinder 8*c* articulated to the frame 2 of the apparatus. By actuating the leveling cylinder 8*c*, it is thus possible to change the transverse slope of the milling roller 5. The freedom of movement necessary in the two hinges 8 and 9 during the adjustment of the transverse slope is achieved by the use of drag bearings.

The milling roller 5 can be adjusted with this adjusting device by means of two adjusting cylinders 11 and 8*c* in height as well as from its parallel position in relation to the level 6.

The roller jacket 5*b* is cylindrical. Both plate strips for fastening the tool holders of the cutting tools 13 designed as straight-shank cutters and guide plates for conveying the separated material at right angles to the direction of travel into the middle of the apparatus, which said guide plates are not shown in the drawings, are welded to the said jacket in one row, in a helical pattern. The conveying space for the separated material in the area of the milling roller 5, which space is limited by the roller jacket 5*a* on the inside and by the cutting circle diameter of the straight-shank cutter on the outside, is physically limited to the outside toward the block being mined by a ring chute 14 mounted in the frame 6 of the apparatus. In the middle of the apparatus, this ring chute 14 is provided with an opening, through which the material being conveyed can reach the level 6 and remains there as a fill. The ring chute 14 is extended by a protective plate 18 in the direction of rotation of the roller.

Figure 5:
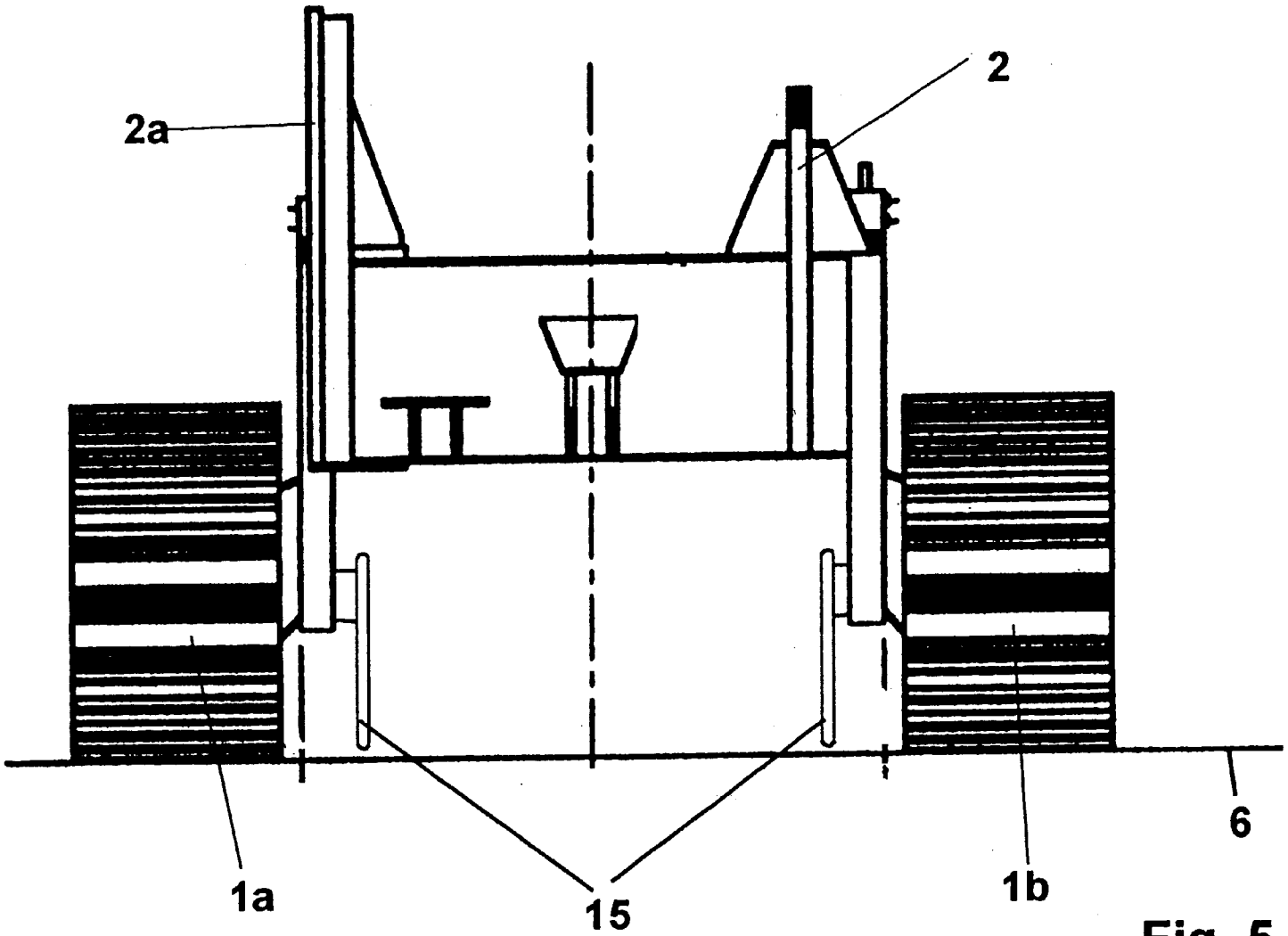
FIG. 5 is a front view of the parts of the apparatus according to FIG. 4.

As in the surface miner of the design according to the German Patent Application Reference No. DE 19941 799.7, and U.S. patent application Ser. No.: 09/385,944 the material is separated from the block being mined by the cutting tools 13 arranged on the milling roller and carried in the direction of rotation in the testing apparatus. The material separated in the outer areas of the milling roller 5 is additionally conveyed to the middle of the apparatus. After the material has left the area of the block being mined, it is led through the ring chute 14 on the outside and thrown onto the level 6 due to its centrifugal force and the ejection plates in the area of the transfer opening. To obtain a sufficient free space for the flight parabola of the material between the opening in the ring chute 14 and the level 6 between the two individual caterpillars 1*a* and 1*b*, the substructure 2 has a gantry-shaped design according to FIG. 5. The two guide plates 15 keep the material away from the two-caterpillar chassis 1. The material can then be picked up from the level 6 by an auxiliary apparatus and loaded on trucks. It is also possible to provide an additional discharge belt for removing the material and thus to avoid an intermediate storage on the level 6. The operation of the apparatus is simple, corresponding to its function. All functions are controlled by radio control. The driver of the apparatus can steer the apparatus from the driver stand 4 or from an external position as desired.

Because of its simple design, the weight of the testing apparatus is also low. If this weight is not sufficient to achieve favorable mining conditions during the adjustment of the apparatus because of vibration or insufficient pressure of the milling roller, the weight of the apparatus can be increased by means of additional weights 16 and 17 on the support frame 7 for the milling roller 5 and at the opposite end of the frame 2 of the apparatus. The position of the center of gravity of the apparatus can also be changed with these weights 16 and 17. Better operating and travel behavior of the apparatus can be achieved as a result.

To obtain results that can be used for the optimized final design of the surface miner with the testing apparatus at a low effort, the parameters such as the overall weight, the drive output and the throughput are used as constant, lower ratios to the final apparatus. The circumferential velocity of the cutting tools 13 and the force acting on each of the individual cutting tools 13 shall be equal in the testing apparatus and the surface miner. The values of the mean cutting width and the depth of cut of a cutting tool 13 are selected to be such that they are as close to one another as possible. The travel speed of the apparatus, which is also the rate of feed at the same time, as well as the speed or rotation of the roller, which determines the circumferential velocity of the cutting tools 13, which is also the cutting speed, are variable in order to obtain the optimal values for the application during the testing.

The following relevant components can be tested and selected and the following parameters are coordinated with one another with the apparatus:

Selection of suitable cutting tools 13,
low-wear design of the tool holders,
possibility of changing the cutting tools 13,
number of cutting tools 13,
distance between the cutting tools 13,
low-wear design of the helical guide plates,
determination of the optimal cutting speed,
determination of the necessary cutting power,
determination of the optimal rate of feed,
optimal weight of the apparatus, and
optimal position of the center of gravity of the apparatus.

The cutting tools 13 are available as straight-shank cutters in various embodiments in terms of their dimensions and the material. The straight-shank cutters that ensure the optimum for the particular area of use are selected.

Together with the cutting speed and the rate of feed, the number of the straight-shank cutters on the roller jacket 10*b* is decisive for the mining output and the particle size of the material mined. Since the straight-shank cutters can be arranged on the roller jacket 5*b* in whole-number lines in the direction of rotation in a V-shaped pattern only and since the distances between the straight-shank cutters shall agree in the testing apparatus and the surface miner; differences in the ratio of the number of the straight-shank cutters per unit area of the block being mined between the two apparatuses cannot be avoided. To obtain results that can be used for the surface miner with the testing apparatus, the rate of feed of the testing apparatus is changed such that the pressure on the straight-shank cutters is as high as the pressure that will foreseeably act on the straight-shank cutters of the surface miner.

The guide plates arranged on the roller jacket 5*b* for the transverse conveying of the material can be optimized on the basis of the signs of wear appearing during the trial run.

The optimal cutting speed and the optimal rate of feed are adjusted during the trial run for an optimal mining output by regulating the drives.

The apparatus can be used both as a testing apparatus for optimizing a larger surface miner and as a simple surface miner.

While specific embodiments of the invention have been shown and described in detail to illustrate the application of the principles of the invention, it will be understood that the invention may be embodied otherwise without departing from such principles.

What is claimed is:

1. A surface mining and testing system comprising:

a small unit with an endless track chassis, an apparatus frame, a drive unit for driving the endless tracks, a milling roller arranged in front of said chassis with respect to a direction of travel, said milling roller being supported by said frame to rotate around a horizontal axis of rotation, substantially at right angles to the direction of travel, to operate with undershot, to be raised and lowered and to extend over an entire width of the apparatus, the milling roller including cutting tools, guide plates, ejection plates and a ring chute in functional connection with said milling roller;

a large unit with a large unit endless track chassis, a large unit apparatus frame, a large unit drive for driving the a large unit endless tracks, a large unit milling roller arranged in front of said large unit chassis with respect to a direction of travel, said a large unit milling roller being supported by said a large unit frame to rotate around a horizontal axis of rotation, substantially at right angles to the direction of travel, to operate with undershot, the large unit milling roller including large unit cutting tools, an overall weight, drive output and throughput of the small unit being set relative to said large unit at a defined ratio, and a circumferential velocity of said cutting tools and a force acting on said cutting tool being substantially the same as a circumferential velocity of said large unit cutting tools and a force acting on said large unit cutting tools and a speed of rotation of said roller and a rate of feed can be varied continuously to optimize mining output.

2. A system in accordance with claim 1, wherein said small unit further comprises at least one of a driver stand with operation controls for a driver directly at said driver stand and a radio control system with operational controls and a radio control unit.

3. A system in accordance with claim 1, wherein said cutting tools and said guide plates are arranged in whole-number lines extending helically in a direction of rotation from the middle to outside and a speed of rotation of said roller of said small unit and a rate of feed are varied as a function of a size of the area of the block being mined such that the pressure acting on the tips of said cutting tools of said small unit is equal to that of said large unit.

4. A system in accordance with claim 1, further comprising additional weights arranged to increase the weight of the small unit and to change a location of a center of gravity of the large unit.

5. A method for designing a full scale surface miner for a specific environment, the method comprising the steps of:

providing a test apparatus with a milling roller having a plurality of cutting tools, a test weight, a test drive with a test output power and a test capacity;

operating said test apparatus in the specific environment;

varying a feed rate and a rotational speed of said milling roller during said operating to provide an optimized mining output;

measuring an optimum circumferential velocity of said cutting tools and an optimum cutting tool force of said test apparatus operating at said optimized mining output;

providing the full scale surface miner with a milling roller having a plurality of cutting tools, a full scale weight, a full scale drive with a full scale output power and a full scale capacity;

designing said full scale weight, said full scale output power and said full scale capacity to be greater than said test weight, said test output power and said test capacity by a predetermined ratio;

designing a circumferential velocity of said cutting tools and a cutting tool force of said full scale surface miner to be substantially similar to said optimum circumferential velocity of said cutting tools and said optimum cutting tool force of said test apparatus.

6. A method in accordance with claim 5, further comprising:

varying a configuration of said plurality of cutting tools on said test apparatus;

determining an optimum test configuration of said cutting tools on said test apparatus for optimal mining output;

designing a configuration of said plurality of cutting tools on said full scale miner to be substantially similar to said optimum test configuration.

7. A method in accordance with claim 6, wherein:

said varying of said configuration of said cutting tools includes varying a density of said cutting tools on said milling roller.

8. A method in accordance with claim 7, wherein:

said varying of said configuration of said cutting tools includes varying a type of said cutting tools on said milling roller;

varying said test weight of said test apparatus to optimize said mining output;

varying a center of gravity of said test apparatus to optimize said mining output;

designing a center of gravity of said full scale miner to be proportional to said center of gravity of said test apparatus.

9. A method in accordance with claim 6, wherein:

said varying of said configuration of said cutting tools includes varying a type of said cutting tools on said milling roller.

10. A method in accordance with claim 5, further comprising:

varying said test weight of said test apparatus to optimize said mining output.

11. A method in accordance with claim 5, further comprising:

varying a center of gravity of said test apparatus to optimize said mining output;

designing a center of gravity of said full scale miner to be proportional to said center of gravity of said test apparatus.

12. A surface mining system for a specific environment, the system comprising:

a test apparatus with a milling roller having a plurality of cutting tools, a test weight, a test drive with a test output power and a test capacity, said test apparatus having an optimum circumferential velocity of said cutting tools and an optimum cutting tool force to create an optimized mining output;

a full scale surface miner with a milling roller having a plurality of cutting tools, said full scale miner also having a full scale weight, full scale output power and full scale capacity greater than said test weight, said test output power and said test capacity by a predetermined ratio, said full scale miner having a circumferential velocity of said cutting tools and a cutting tool force substantially similar to said optimum circumferential velocity of said cutting tools and said optimum cutting tool force of said test apparatus.

13. A system in accordance with claim 12, further comprising;

a density of said plurality of cutting tools on said test apparatus being optimized for said optimized mining output;

at density of said plurality of cutting tools on said full scale miner being substantially similar to said density of said cutting tools on said test apparatus.

14. A system in accordance with claim 12, further comprising;

a density of said plurality of cutting tools on said test apparatus being optimized for said optimized mining output;

a density of said plurality of cutting tools on said full scale miner being substantially similar to said density of said cutting tools on said test apparatus;

a type of said plurality of cutting tools on said test apparatus being optimized for said optimized mining output;

a type of said plurality of cutting tools on said full scale miner being substantially similar to said type of said cutting tools on said test apparatus;

said test weight of said test apparatus is optimized for said optimized mining output;

a center of gravity of said test apparatus is optimized for said optimized said mining output;

a center of gravity of said full scale miner is proportional to said center of gravity of said test apparatus.

15. A system in accordance with claim 12, further comprising:

a pivoting device, said milling roller being supported pivotably on said test apparatus with transverse slope adjustment provided on one of two sides by a vertical adjustability of said pivoting device in relation to said test apparatus.

16. A system in accordance with claim 12, an adjusting member comprising a support frame including a fork-shaped pivot arm provided for the height-adjustable arrangement of said milling roller, said support frame being connected to said test apparatus in an articulated manner, and bearings for receiving said milling roller by a shaft of said milling roller, said bearings being provided between two free ends of said support frame, and a lifting cylinder arranged between said test apparatus and said support frame.

17. A system in accordance with claim 16, wherein an articulated connection of said support frame to said test apparatus comprises a right-hand and left-hand hinge each with a hinge pin, wherein one of said two hinges is arranged stationarily on said test apparatus and said hinge pin on a side of a vertically displaceable hinge receives said support frame centrally relative to an overall length and is guided on one side in a vertical groove located in a support belonging to said test apparatus and is in a functional connection with a leveling cylinder arranged on said test apparatus on another side, and hinge connections of said hinge pins with said test apparatus are self-aligning bearings.

18. A system in accordance with claim 12, further comprising operation controls provided at least for a driver directly at said driver stand or from an outside via a radio control unit.

19. A system in accordance with claim 13, further comprising: a driver stand on said test apparatus, said driver stand having operation controls for a driver directly at said driver stand and a radio control system with operational controls and a radio control unit.

* * * * *